US006799917B1

(12) United States Patent
Sampson

(10) Patent No.: US 6,799,917 B1
(45) Date of Patent: Oct. 5, 2004

(54) SOAP WITH RETENTION DEVICE

(76) Inventor: Ralph L. Sampson, 20120 Santa Rita St., Woodland Hills, CA (US) 91364

( * ) Notice: Subject to any disclaimer, the term of this patent is extended or adjusted under 35 U.S.C. 154(b) by 0 days.

(21) Appl. No.: 10/313,756

(22) Filed: Dec. 5, 2002

(51) Int. Cl.[7] ..... A45D 40/00
(52) U.S. Cl. ..... 401/88; 401/8; 248/693
(58) Field of Search ..... D28/8.1; 401/88, 401/131, 201, 8; 248/317, 690, 693; 24/11 SH

(56) References Cited

U.S. PATENT DOCUMENTS

| | | | | | |
|---|---|---|---|---|---|
| 2,042,104 | A | | 5/1936 | Kane | 510/439 |
| 2,243,634 | A | * | 5/1941 | Kadish | 401/8 |
| 2,319,847 | A | | 5/1943 | Clanton | 401/266 |
| 2,679,709 | A | * | 6/1954 | Du Bois | 248/579 |
| 2,883,791 | A | * | 4/1959 | Ballo | 401/8 |
| 2,900,757 | A | * | 8/1959 | Grimm, Jr. | 401/88 |
| 2,934,852 | A | * | 5/1960 | Heberling | 248/690 |
| 3,124,827 | A | | 3/1964 | Hull | 401/201 |
| 3,160,523 | A | | 12/1964 | Hull | 510/143 |
| 3,206,152 | A | | 9/1965 | Wimmer | 401/8 |
| 3,251,571 | A | | 5/1966 | Ernest | 248/693 |
| 3,671,438 | A | | 6/1972 | Cilia | 510/146 |
| 3,693,923 | A | | 9/1972 | Ayoube et al. | 248/690 |
| 3,886,987 | A | | 6/1975 | Schuchman | 15/159.1 |
| 4,181,695 | A | | 1/1980 | Rickert | 268/150 |
| 4,391,427 | A | | 7/1983 | Foresman | 248/176.1 |
| D271,910 | S | | 12/1983 | Blaszkowski | 55/308 |
| 4,458,871 | A | | 7/1984 | van Allen | 248/309.2 |
| 4,741,852 | A | | 5/1988 | Ondracek | 510/143 |
| 5,020,753 | A | | 6/1991 | Green | 248/176.1 |
| 5,207,725 | A | * | 5/1993 | Pinkerton | 383/24 |
| 5,366,125 | A | | 11/1994 | Procido | 224/622 |
| D397,507 | S | | 8/1998 | Bern | 91/157 |
| 6,048,407 | A | | 4/2000 | Schoch | 134/6 |
| 6,325,882 | B1 | | 12/2001 | Schroeder | 156/228 |
| 6,397,438 | B1 | | 6/2002 | DeWan | 24/306 |
| 6,543,951 | B1 | * | 4/2003 | Bauman | 401/8 |

FOREIGN PATENT DOCUMENTS

| | | | |
|---|---|---|---|
| DE | 019963449 A1 | * | 8/2000 |
| FR | 2576317 A1 | * | 7/1986 |
| FR | 2650168 A1 | * | 2/1991 |
| JP | 408041500 A | * | 2/1996 |

* cited by examiner

*Primary Examiner*—Leslie A. Braun
*Assistant Examiner*—Jon Szumny
(74) *Attorney, Agent, or Firm*—David A. Belasco; Belasco Jacobs & Townsley, LLP

(57) ABSTRACT

A bar of soap with retention device includes a bar of soap with an aperture bored through it extending from the top surface to the bottom surface or from a first side edge to a second side edge. An elastic member attaches the bar of soap to a handling means through the aperture. The handling means includes an opening for attachment to the elastic member. The handling means is typically form as a ring but may have a series of finger indents within the opening or formed as a rod or handle. The elastic member is attached to the handling means by passing it through the opening in the handling means, passing both ends through the aperture and around each side of the bar and over the handling means to rest about the center of the elastic member. The retention device may be added to an existing bar of soap.

7 Claims, 5 Drawing Sheets

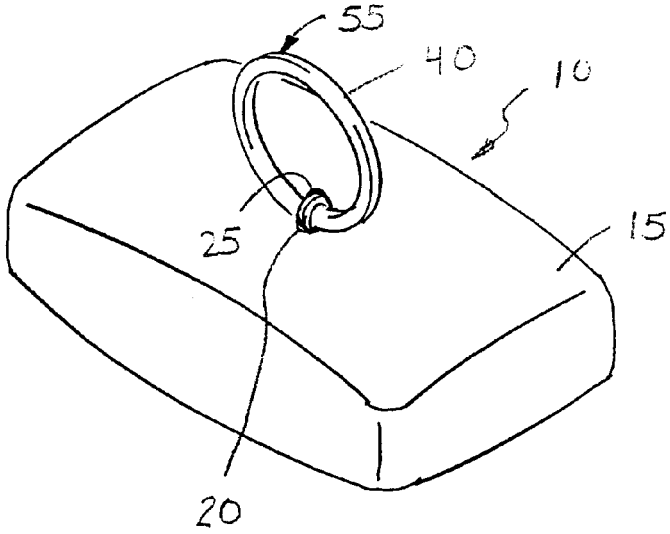
Fig. 1
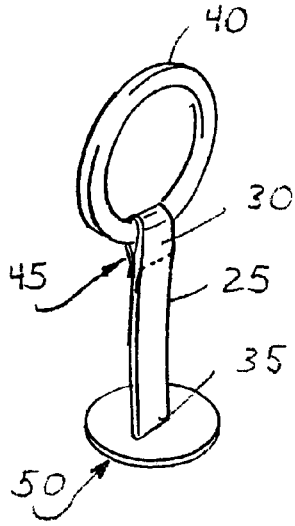
Fig. 2
Fig. 3
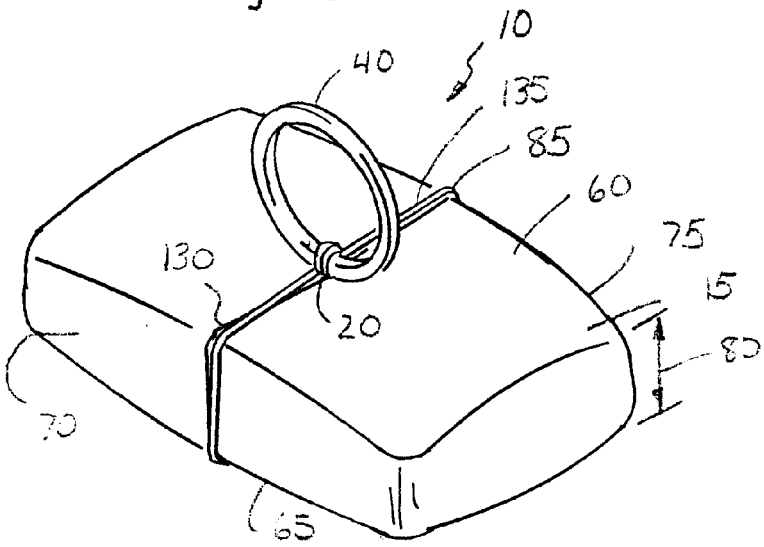

Fig. 4
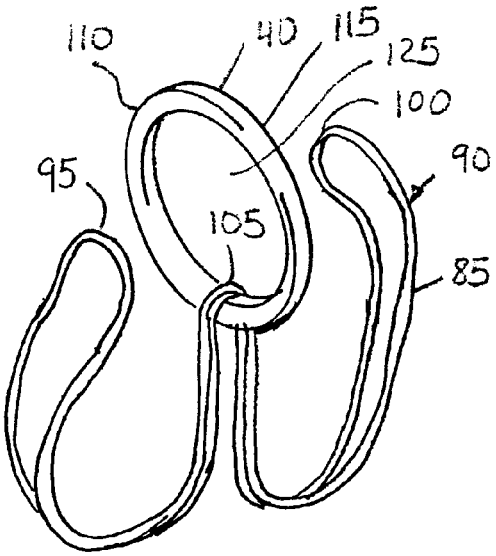
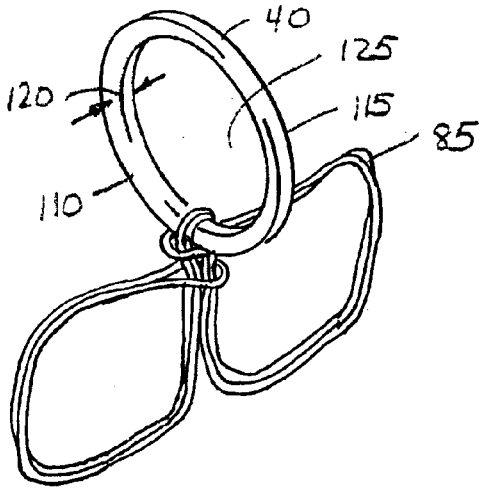
Fig 5
Fig. 6
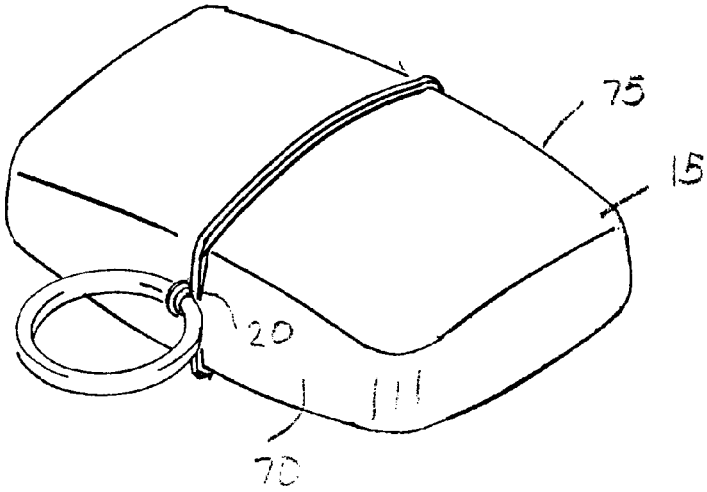

Fig. 7
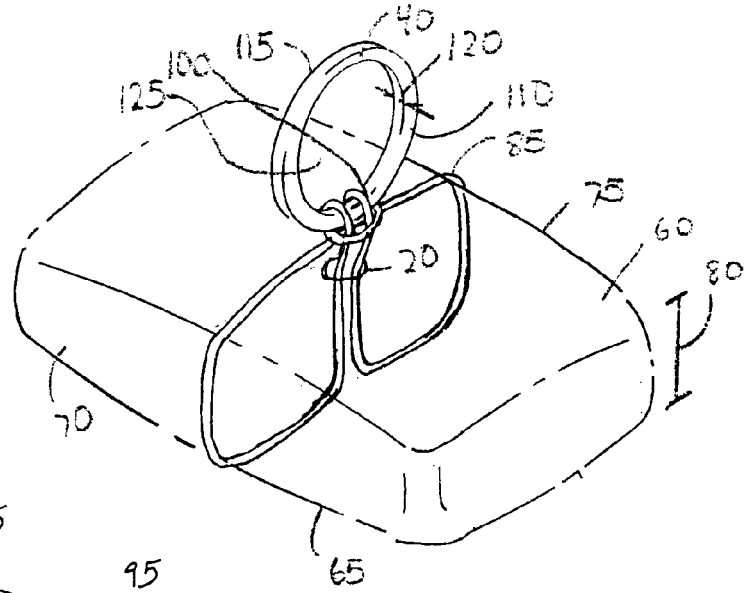
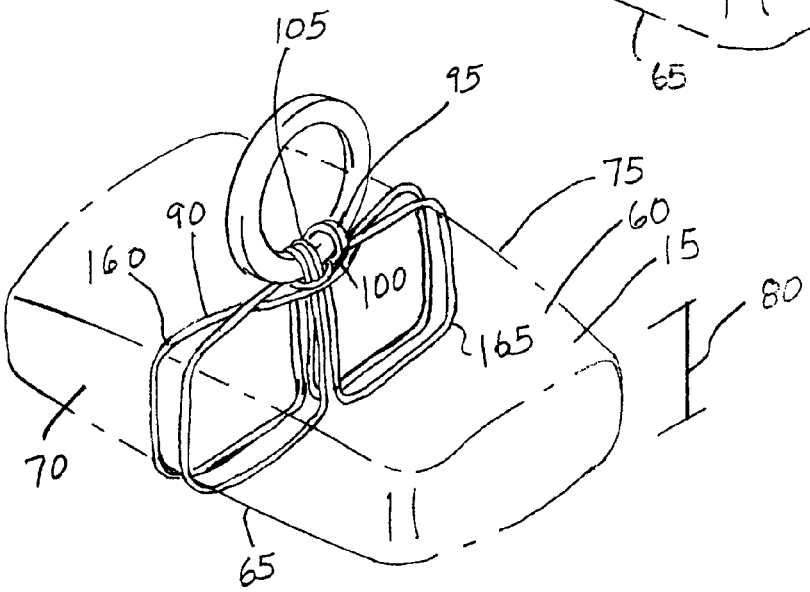
Fig 8
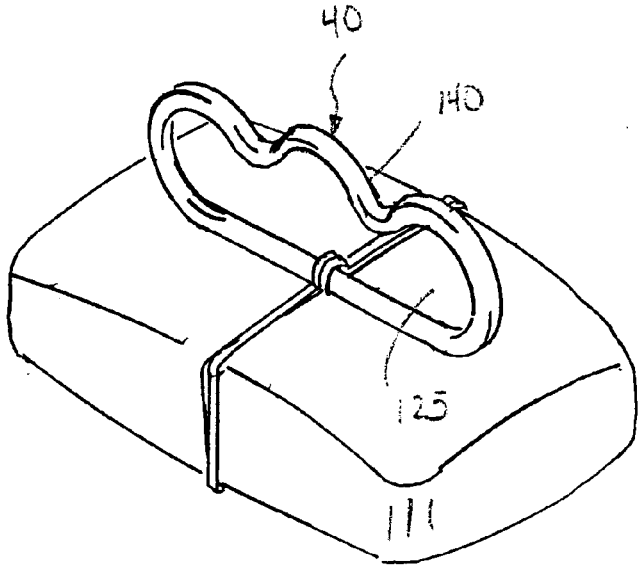
Fig. 9

SOAP WITH RETENTION DEVICE

FIELD OF INVENTION

The invention pertains to soap products. More particularly, the invention relates to a device for handling and control of a wet bar of soap in a bath or shower environment.

BACKGROUND OF THE INVENTION

A wet bar of soap can present myriad hazards when handled in a wet environment. It is easy to drop a wet bar of soap, step on it while attempting to retrieve it and fall on hard tile or enamel surfaces resulting in serious injury. Various devices and techniques have been developed to provide improved means for controlling and handling soap bars in the bath, shower and kitchen environments.

U.S. Pat. No. 3,206,152 issued to Wimmer is directed to a means for supporting or suspending soap. Each form of the invention uses an elastic strand with a cake of soap in which the elastic strand passes through the soap, coupled to a container for the soap, or embedded in the soap.

U.S. Pat. No. 3,671,438 issued to Cilia, is directed to a soap and container therefore. The bar of soap has an aperture with insert to prevent the aperture from gradually expanding in size as the soap is continued to be used. The aperture provides the means by which the soap is supported in the container.

U.S. Pat. No. 2,319,847, issued to Clanton is directed to a non-slip holder for cake soap. The holder for the cake of soap comprises an envelope of a cage of a size to encompass a cake of soap, and on one face of the cage there is provided a pair of upstanding finger loops through which the user may project certain fingers to further assure that the cage and its contents will be held firmly when in use. Further, as the soap size diminishes it will remain within the holder.

U.S. Pat. No. 3,251,571 issued to Ernest is directed to a soap holder and adjustable loop. An adjustable loop is provided that may be tightened around a bar of soap to hold it securely even as its size diminishes with use, using a tightening device or cramp with an opening for tightening purposes.

U.S. Pat. No. 4,458,871 issued to van Allen discloses a soap spindle. The soap holder is designed to hold a cake of soap that has a centrally disposed cylindrical cavity formed through its least dimension.

While other variations exist, the above-described designs for soap with retention devices are typical of those encountered in the prior art. It is an objective of the present invention to provide means for holding, picking up and controlling a wet bar of soap. It is a further objective to provide such means in a simple, economical device that may be easily installed on a bar of soap. It is a still further objective of the invention to provide a device that will continue to fit snugly on the bar of soap as it shrinks in size. It is yet a further objective to provide a soap with retention device that can be sold already packaged with a new bar of soap or may be added to existing bars as an add-on accessory.

While some of the objectives of the present invention are disclosed in the prior art, none of the inventions found include all of the requirements identified.

SUMMARY OF THE INVENTION

The present invention addresses all of the deficiencies of prior art soap with retention device inventions and satisfies all of the objectives described above.

(1) A bar of soap with retention device providing the desired features may be constructed from the following components. A bar of soap is provided. The bar of soap has an aperture through it. An elastic member is provided. The elastic member has a first end and a second end. At least one handling means is provided. The handling means includes means for attaching to the first end of the elastic member. The second end of the elastic member extends through the aperture of the bar of soap. Means are provided for attaching the second end of the elastic member to the bar of soap. When the handling means is attached to the elastic member and the elastic member is attached to the bar of soap, the bar of soap will be provided with means for easily handling the bar.

(2) In a variant of the invention, a bar of soap is provided. The bar of soap has a top surface, a bottom surface, first and second side edges and a first predetermined thickness. An aperture is provided. The aperture penetrates the bar of soap and extends through it. An elastic member is provided. The elastic member is formed as a closed loop and has a first end, a second end and a center section. At least one handling means is provided. The handling means has a first side, a second side, a second predetermined thickness and an opening. The opening extends from the first side to the second side. The center section of the elastic member is located within the opening of the handling means.

The first and second ends of the elastic member are passed through the aperture of the bar of soap and extend outwardly from it. The first end of the elastic member extends around the bar of soap in a first direction, is stretched over the handling means and located about the center section of the elastic member. The second end of the elastic member extends around the bar of soap in a second, opposite direction, is stretched over the handling means and located about the center section of the elastic member. When the elastic member is so located with respect to the bar of soap and the handling means, the handling means will be removably and elastically attached to the bar of soap.

(3) In another variant of the invention, a bar of soap is provided. The bar of soap has a top surface, a bottom surface, first and second side edges and a first predetermined thickness. An aperture is provided. The aperture penetrates the bar of soap and extends through it. First and second elastic members are provided. Each of the first and second elastic members is formed as a closed loop and has a first end, a second end and a center section. At least one handling means is provided. The handling means has a first side, a second side, a second predetermined thickness and an opening, the opening extending from the first side to the second side.

The center sections of each the elastic members are located within the opening of the handling means. The first ends of the elastic members are passed through the closed loop of the elastic members, thereby attaching the first ends to the handling means. The second ends of the first and second elastic members are passed through the aperture of the bar of soap and extend outwardly from it. The second end of the first elastic member extends around the bar of soap in a first direction, is stretched over the handling means and located about the center section of the elastic members. The second end of the second elastic member extends around the bar of soap in a second, opposite direction, is stretched over the handling means and located about the center section of the elastic members. When the elastic members are so located with respect to the bar of soap and the handling means, the handling means will be removably and elastically attached to the bar of soap.

(4) In a further variant, a bar of soap is provided. The bar of soap has a top surface, a bottom surface, first and second side edges and a first predetermined thickness. An aperture is provided. The aperture penetrates the bar of soap and extends through it. An elastic member is provided. The elastic member is formed as a closed loop and has a first end, a second end and a center section. At least one handling means is provided. The handling means has a first side, a second side, a second predetermined thickness and an opening. The opening extends from the first side to the second side.

The first end of the elastic member extends through the aperture. The second end of the elastic member is passed through the closed loop adjacent the first end, thereby securing the first end of the elastic member to the bar of soap. The second end of the elastic member is passed through the opening in the handling means and then over the bar of soap, thereby securing the second end of the elastic member to the handling means. When the elastic member is so located with respect to the bar of soap and the handling means, the handling means will be removably and elastically attached to the bar of soap.

(5) In yet a further variant, a bar of soap is provided. The bar of soap has a top surface, a bottom surface, first and second side edges and a first predetermined thickness. An aperture is provided. The aperture penetrates the bar of soap and extends through it. An elastic member is provided. The elastic member is formed as a closed loop and has a first end, a second end and a center section. At least one handling means is provided. The handling means has a first side, a second side, a second predetermined thickness and an opening. The opening extends from the first side to the second side.

A retainer clip is provided. The retainer clip is formed of semi-rigid planar material of a third predetermined thickness. The retainer clip has first and second ends and a surrounding edge. The retainer clip has a narrowed portion substantially equidistant from the first and second ends. The center section of the elastic member is located within the opening of the handling means. The first and second ends of the elastic member being passed through the aperture of the bar of soap and extend outwardly from it. The first and second ends of the elastic member are passed over the first and second ends of the retainer clip and located in the narrowed portion of the retainer clip. When the elastic member is so located with respect to the bar of soap, the handling means and the retainer clip, the handling means will be removably and elastically attached to the bar of soap.

(6) In another variant of the invention, a bar of soap is provided. The bar of soap has a top surface, a bottom surface, first and second side edges and a first predetermined thickness. An aperture is provided. The aperture penetrates the bar of soap and extends through it. An elastic member is provided. The elastic member is formed as a closed loop and has a first end, a second end and a center section. At least one handling means is provided. The handling means has a first side, a second side, a second predetermined thickness and an opening. The opening extends from the first side to the second side. A retainer clip is provided. The retainer clip is formed of semi-rigid planar material of a third predetermined thickness. The retainer clip has first and second ends and a surrounding edge. The retainer clip has a narrowed portion substantially equidistant from the first and second ends. The first end of the elastic member extends through the aperture. The second end of the elastic member is passed through the closed loop adjacent the first end, thereby securing the first end of the elastic member to the bar of soap. The first end of the elastic member is passed over the first and second ends of the retainer clip and located in the narrowed portion of the retainer clip. When the elastic member is so located with respect to the bar of soap, the handling means and the retainer clip, the handling means will be removably and elastically attached to the bar of soap.

(7) In still a further variant, the aperture extends from the top surface to the bottom surface of the bar of soap.

(8) In another variant of the invention, the aperture extends from the first side edge to the second side edge of the bar of soap.

(9) In yet another variant, the handling means is at least one ring.

(10) In a further variant, the handling means includes a series of finger-shaped indents in the opening.

(11) In still a further variant, the handling means includes an upwardly pointing rod.

(12) In a final variant of the invention, a kit for attaching a handling means to a bar of soap is provided. The kit includes means for creating an aperture in a bar of soap. An elastic member is provided. The elastic member is formed as a closed loop and has a first end, a second end and a center section. At least one handling means is provided. The handling means has a first side, a second side, a second predetermined thickness and an opening. The opening extends from the first side to the second side. When the means for creating an aperture in a bar of soap is applied to a bar of soap and the elastic member is attached to the handling means and the bar of soap through the aperture, a bar of soap with attached retention device will be formed.

DESCRIPTION OF THE DRAWINGS

FIG. 1 is a perspective view of a first embodiment of the invention illustrating a handling means and elastic member;

FIG. 2 is a perspective view of a handling means, elastic member and means for attaching same to a bar of soap;

FIG. 3 is a perspective view of a second embodiment of the invention illustrating a handling means and elastic member fastened around a bar of soap;

FIG. 4 is a perspective view of an elastic member and a handling means used with the FIG. 3 embodiment prior to assembly;

FIG. 5 is a perspective view of an elastic member and a handling means used with the FIG. 3 embodiment illustrating the means for fastening to a bar of soap;

FIG. 6 is a perspective view of the FIG. 3 embodiment with an aperture penetrating an edge of the bar of soap;

FIG. 7 is a perspective view of a third embodiment of the invention illustrating a handling means and elastic member fastened through the handling means and around a bar of soap;

FIG. 8 is a perspective view of a fourth embodiment of the invention illustrating a handling means and two elastic member fastened through the handling means and around a bar of soap;

FIG. 9 is a perspective view of the second embodiment of the invention illustrating a handling means with finger grips;

DETAILED DESCRIPTION OF THE PREFERRED EMBODIMENT (1) FIG. 1 and FIG. 2 illustrate a bar of soap with retention device 10 providing the desired features that may be constructed from the following components. A bar of soap 15 is provided. The bar of soap 15 has an aperture 20 through it. An elastic member 25 is provided. The elastic member 25 has a first end 30 and a second end 35. At least one handling means 40 is provided. The handling means 40 includes means 45 for attaching to the first end 30 of the elastic member 25. The second end 35 of the elastic member 25 extends through the aperture 20 of the bar of soap 15. Means 50 are provided for attaching the second end 35 of the elastic member 25 to the bar of soap 15. When the handling means 40 is attached to the elastic member 25 and the elastic member 25 is attached to the bar of soap 15, the bar of soap 15 will be provided with means 55 for easily handling the bar 15.

Figure 10:
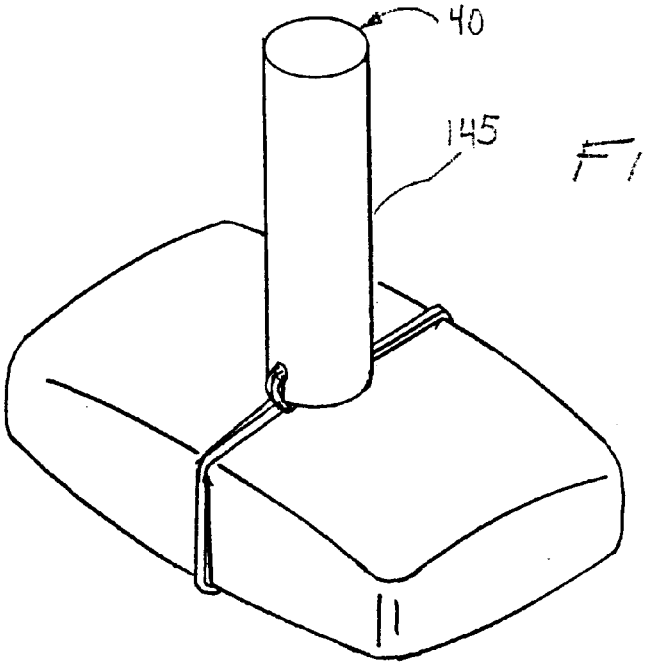
FIG. 10 is a perspective view of the second embodiment of the invention illustrating a handling means that includes an upwardly pointing rod.

(2) In a variant of the invention, as shown in FIG. 3, FIG. 4 and FIG. 5, a bar of soap 15 is provided. The bar of soap 15 has a top surface 60, a bottom surface 65, first 70 and second 75 side edges and a first predetermined thickness 80. An aperture 20 is provided. The aperture 20 penetrates the bar of soap 15 and extends through it. An elastic member 85 is provided. The elastic member 85 is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115. The center section 105 of the elastic member 85 is located within the opening 125 of the handling means 40.

The first 95 and second 100 ends of the elastic member 85 are passed through the aperture 20 of the bar of soap 15 and extend outwardly from it. The first end 95 of the elastic member 85 extends around the bar of soap 15 in a first direction 130, is stretched over the handling means 40 and located about the center section 105 of the elastic member 85. The second end 100 of the elastic member 85 extends around the bar of soap 15 in a second 135, opposite direction, is stretched over the handling means 40 and located about the center section 105 of the elastic member 85. When the elastic member 85 is so located with respect to the bar of soap 15 and the handling means 40, the handling means 40 will be removably and elastically attached to the bar of soap 15.

(3) In another variant of the invention, as shown in FIG. 8, a bar of soap 15 is provided. The bar of soap 15 has a top surface 60, a bottom surface 65, first 70 and second 75 side edges and a first predetermined thickness 80. An aperture 20 is provided. The aperture 20 penetrates the bar of soap 15 and extends through it. First 160 and second 165 elastic members are provided. Each of the first 160 and second 165 elastic members is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115.

The center sections 105 of each the elastic members 160, 165 are located within the opening 125 of the handling means 40. The first ends 95 of the elastic members 160, 165 are passed through the closed loops 90 of the elastic members 160, 165, thereby attaching the first ends 95 to the handling means 40. The second ends 100 of the first 160 and second 165 elastic members are passed through the aperture 20 of the bar of soap 15 and extend outwardly from it. The second end 100 of the first elastic member 160 extends around the bar of soap 15 in a first direction 130, is stretched over the handling means 40 and located about the center section 105 of the elastic members 160, 165. The second end 100 of the second elastic member 165 extends around the bar of soap 15 in a second, opposite direction 135, is stretched over the handling means 40 and located about the center section 105 of the elastic members 160, 165. When the elastic members 160, 165 are so located with respect to the bar of soap 15 and the handling means 40, the handling means 40 will be removably and elastically attached to the bar of soap 15.

(4) In a further variant, as shown in FIG. 7, a bar of soap 15 is provided. The bar of soap 15 has a top surface 60, a bottom surface 65, first 70 and second 75 side edges and a first predetermined thickness 80. An aperture 20 is provided. The aperture 20 penetrates the bar of soap 15 and extends through it. An elastic member 85 is provided. The elastic member 85 is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115.

The first end 95 of the elastic member 85 extends through the aperture 20. The second end 100 of the elastic member 85 is passed through the closed loop 90 adjacent the first end 95, thereby securing the first end 95 of the elastic member 85 to the bar of soap 15. The second end 100 of the elastic member 85 is passed through the opening 125 in the handling means 40 and then over the bar of soap 15, thereby securing the second end 100 of the elastic member 85 to the handling means 40. When the elastic member 85 is so located with respect to the bar of soap 15 and the handling means 40, the handling means 40 will be removably and elastically attached to the bar of soap 15.

Figure 12:
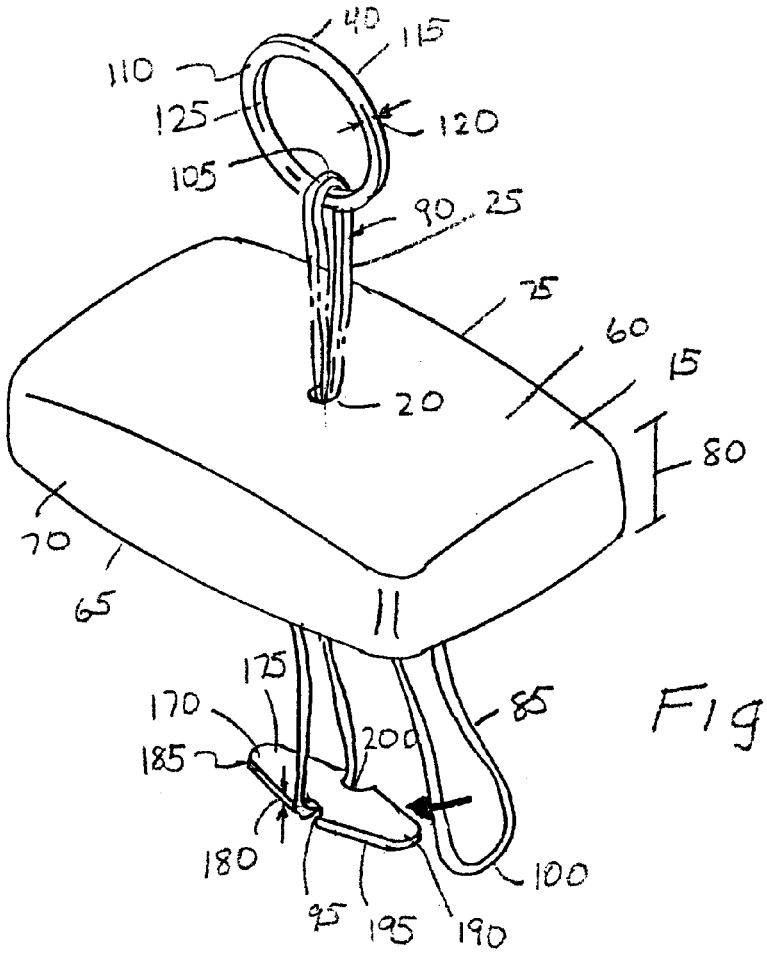
FIG. 12 is a perspective view of the fifth embodiment of the invention illustrating a handling means and elastic member fastened through the handling means and around a retainer clip.

(5) In yet a further variant, as shown in FIG. 12, a bar of soap 15 is provided. The bar of soap 15 has a top surface 60, a bottom surface 65, first 70 and second 75 side edges and a first predetermined thickness 80. An aperture 20 is provided. The aperture 20 penetrates the bar of soap 15 and extends through it. An elastic member 85 is provided. The elastic member 85 is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115.

A retainer clip 170 is provided. The retainer clip 170 is formed of semi-rigid planar material 175 of a third predetermined thickness 180. The retainer clip 170 has first 185 and second 190 ends and a surrounding edge 195. The retainer clip 170 has a narrowed portion 200 substantially equidistant from the first 185 and second 190 ends. The center section 105 of the elastic member 85 is located within the opening 125 of the handling means 40. The first 95 and second 100 ends of the elastic member 85 are passed through the aperture 20 of the bar of soap 15 and extend outwardly from it. The first 95 and second 100 ends of the elastic member 85 are passed over the first 185 and second 190 ends of the retainer clip 170 and located in the narrowed portion 200 of the retainer clip 170. When the elastic member 85 is so located with respect to the bar of soap 15, the handling means 40 and the retainer clip 170, the handling means 40 will be removably and elastically attached to the bar of soap 15.

Figure 14:
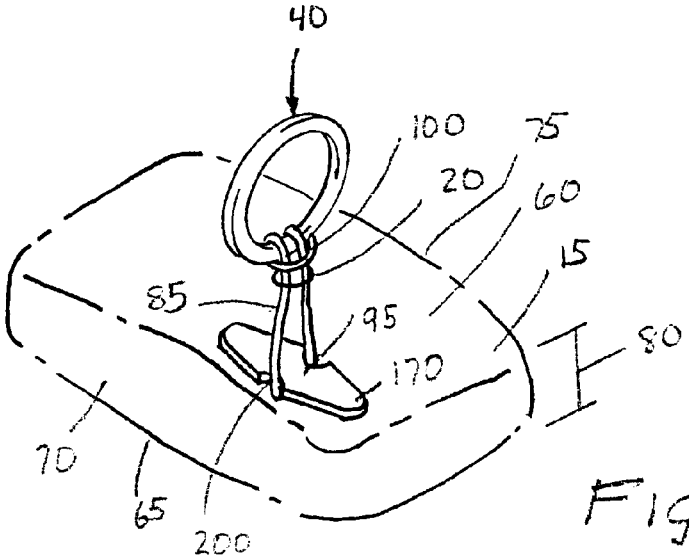
FIG. 14 is a perspective view of the sixth embodiment of the invention illustrating a handling means and elastic member fastened through the handling means and around a retainer clip.

(6) In another variant of the invention, as shown in FIG. 14, a bar of soap 15 is provided. The bar of soap 15 has a top surface 60, a bottom surface 65, first 70 and second 75 side edges and a first predetermined thickness 80. An aperture 20 is provided. The aperture 20 penetrates the bar of soap 15 and extends through it. An elastic member 85 is provided. The elastic member 85 is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115. A retainer clip 170 is provided. The retainer clip 170 is formed of semi-rigid planar material 175 of a third predetermined thickness 180. The retainer clip 170 has first 185 and second 190 ends and a surrounding edge 195. The retainer clip 170 has a narrowed portion 200 substantially equidistant from the first 185 and second 190 ends. The first end 95 of the elastic member 85 extends through the aperture 20. The second end 100 of the elastic member 85 is passed through the closed loop 90 adjacent the first end 95, thereby securing the first end 95 of the elastic member 85 to the bar of soap 15. The first end 95 of the elastic member 85 is passed over the first 185 and second 190 ends of the retainer clip 170 and located in the narrowed portion 200 of the retainer clip 170. When the elastic member 85 is so located with respect to the bar of soap 15, the handling means 40 and the retainer clip 170, the handling means 40 will be removably and elastically attached to the bar of soap 15.

(7) In still a further variant, as shown in FIGS. 1, 3, 7, 8, 9, 10, 11,12 and 14, the aperture 20 extends from the top surface 60 to the bottom surface 65 of the bar of soap 15.

(8) In another variant of the invention, as shown in FIG. 6, the aperture 20 extends from the first side edge 70 to the second side edge 75 of the bar of soap 15.

Figure 11:
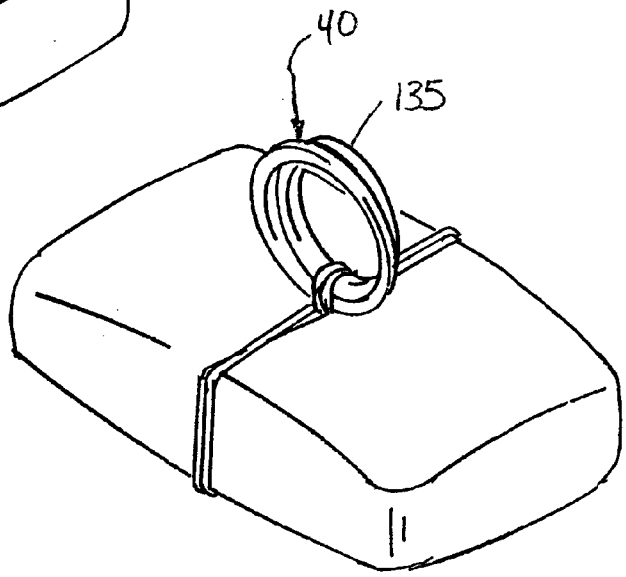
FIG. 11 is a perspective view of the second embodiment of the invention illustrating a handling means that includes two rings.

(9) In yet another variant, as shown in FIG. 11, the handling means 40 is at least one ring 135.

(10) In a further variant, as shown in FIG. 9, the handling means 40 includes a series of finger-shaped indents 140 in the opening 125.

(11) In still a further variant, as shown in FIG. 10, the handling means 40 includes an upwardly pointing rod 145.

Figure 13:
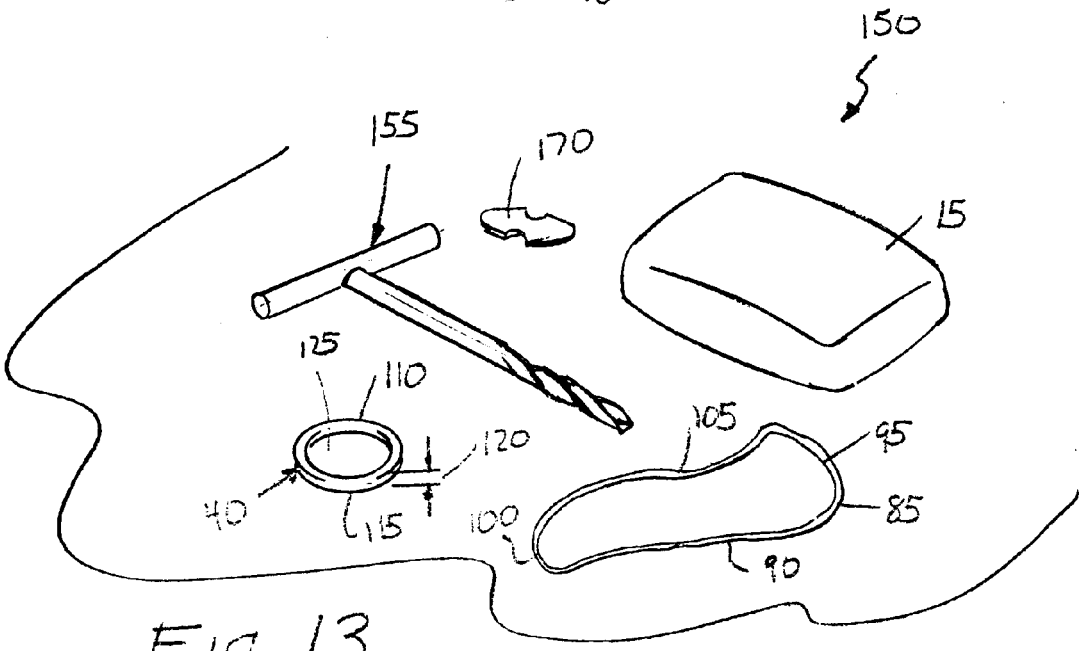
FIG. 13 is a perspective view of a kit for providing a handling means attached to a bar of soap with an elastic means.

(12) In a final variant of the invention, as shown in FIG. 13, a kit 150 for attaching a handling means 40 to a bar of soap 15 is provided. The kit 150 includes means 155 for creating an aperture 20 in a bar of soap 15. An elastic member 85 is provided. The elastic member 85 is formed as a closed loop 90 and has a first end 95, a second end 100 and a center section 105. At least one handling means 40 is provided. The handling means 40 has a first side 110, a second side 115, a second predetermined thickness 120 and an opening 125. The opening 125 extends from the first side 110 to the second side 115. When the means 155 for creating an aperture 20 in a bar of soap 15 is applied to a bar of soap 15 and the elastic member 85 is attached to the handling means 40 and the bar of soap 15 through the aperture 20, a bar of soap 15 with attached retention device 10 will be formed.

The bar of soap with retention device 10 has been described with reference to particular embodiments. Other modifications and enhancements can be made without departing from the spirit and scope of the claims that follow.

What is claimed is:

1. A bar of soap with retention device, comprising:

a bar of soap, said bar of soap having a top surface, a bottom surface, first and second side edges and a first predetermined thickness;

an aperture, said aperture penetrating said bar of soap and extending therethrough;

an elastic member, said elastic member being formed as a closed loop and having a first end, a second end and a center section;

at least one handling means, said handling means having a first side, a second side, a second predetermined thickness and an opening, said opening extending from said first side to said second side;

a retainer clip, said retainer clip being formed of semi-rigid planar material of a third predetermined thickness and having first and second ends and a surrounding edge, said retainer clip having a narrowed portion substantially equidistant from said first and second ends;

said center section of said elastic member being disposed within said opening of said handling means;

said first and second ends of said elastic member being passed through said aperture of said bar of soap and extending outwardly therefrom;

said first and second ends of said elastic member being passed over said first and second ends of said retainer clip and disposed in said narrowed portion of said retainer clip; and whereby, when said elastic member is so disposed with respect to said bar of soap, said handling means and said retainer clip, said handling means will be removably and elastically attached to said bar of soap.

2. A bar of soap with retention device, comprising:

a bar of soap, said bar of soap having a top surface, a bottom surface, first and second side edges and a first predetermined thickness;

an aperture, said aperture penetrating said bar of soap and extending therethrough;

an elastic member, said elastic member being formed as a closed loop and having a first end, a second end and a center section;

at least one handling means, said handling means having a first side, a second side, a second predetermined thickness and an opening, said opening extending from said first side to said second side;

a retainer clip, said retainer clip being formed of semi-rigid planar material of a third predetermined thickness and having first and second ends and a surrounding edge, said retainer clip having a narrowed portion substantially equidistant from said first and second ends;

said first end of said elastic member extending through said aperture;

said second end of said elastic member being passed through said closed loop adjacent said first end, thereby securing said first end of said elastic member to said bar of soap;

said first end of said elastic member being passed over said first and second ends of said retainer clip and disposed in said narrowed portion of said retainer clip; and whereby, when said elastic member is so disposed with respect to said bar of soap, said handling means and said retainer clip, said handling means will be removably and elastically attached to said bar of soap.

3. The bar of soap with retention device as described in claim 1 or 2, wherein said aperture extends from said top surface to said bottom surface.

4. The bar of soap with retention device as described in claim 1 or 2, wherein said aperture extends from said first side edge to said second side edge.

5. The bar of soap with retention device as described in claim 1 or 2, wherein the handling means is at least one ring.

6. The bar of soap with retention device as described in claim 1 or 2, wherein the handling means includes a series of finger-shaped indents in the opening.

7. The bar of soap with retention device as described in claim 1 or 2, wherein the handling means includes an upwardly pointing rod.

* * * * *